United States Patent [19]

Hood et al.

[11] 4,059,063

[45] Nov. 22, 1977

[54] ROLL-FURLING MAINSAIL

[75] Inventors: Frederick E. Hood; Donald K. Mitchell; Gary S. Uhring, all of Marblehead, Mass.

[73] Assignee: Hood Sailmakers, Inc., Marblehead, Mass.

[21] Appl. No.: 718,870

[22] Filed: Aug. 30, 1976

[51] Int. Cl.[2] ..... B63H 9/10

[52] U.S. Cl. ..... 114/106; 114/39; 114/102; 114/111

[58] Field of Search ..... 114/104–109, 114/111, 115, 102, 97, 98, 90, 101, 219, 39

[56] References Cited

U.S. PATENT DOCUMENTS

| | | | |
|---|---|---|---|
| 601,282 | 3/1898 | Sands | 114/108 |
| 2,965,407 | 12/1960 | Meisen | 114/219 X |
| 3,534,700 | 10/1970 | Marshall | 114/101 X |
| 3,678,876 | 7/1972 | Alter | 114/102 |
| 3,795,215 | 3/1974 | Butler | 114/90 |
| 3,835,804 | 9/1974 | Jackson | 114/90 X |

*Primary Examiner*—George E. A. Halvosa
*Assistant Examiner*—Sherman D. Basinger
*Attorney, Agent, or Firm*—Kenway & Jenney

[57] ABSTRACT

In the roll-furling mainsail arrangement disclosed herein, the clew of the sail is trimmed to a boom by means of a car which is freely slidable along the boom. An outhaul line rigged to pull aft from the tip of the boom passes forward through a block on the car, thence through a block at the clew of the sail and then back to the car where it is secured. The balance of forces on the car automatically bias it to a position providing an advantageous drawing angle for shaping the mainsail, even at varying stages of partial furling.

6 Claims, 3 Drawing Figures

ROLL-FURLING MAINSAIL

BACKGROUND OF THE INVENTION

The present invention relates to roll-furling mainsails and more particularly to apparatus for securing the clew of such a sail to a boom at varying stages of partial furling.

At the present time, roller-furling jibs for cruising sailboats are enjoying a great degree of popularity and roll-furling mainsails are attracting increased interest. Various roller-furling mainsail rigs have been proposed which provide roller-furling on a rotatable rod supported under tension just aft of the mast. More recently, it has been proposed that such a mainsail be roller-furled within a tubular compartment inside the mast with the sail being drawn out through an aft-facing slot in the mast. Such an arrangement is shown in U.S. Pat. No. 3,835,804 issued on Sept. 17, 1974 to Patrick T. Jackson of Boothbay Harbor, Maine.

By and large, such roller-furling mainsails, whether furled within or without the mast proper, are of a generally loose-footed construction. In other words, the foot of the mainsail is not secured to a boom along its entire length as is more conventional for a mainsail. Rather, if a boom is used at all, only the clew is secured to the boom. Further, if the clew is secured only to the tip of the boom, i.e., by an outhaul line, it has been found difficult to effectively trim the sail at varying stages of partial furling, even though adjustments are made in the tension of the outhaul, the main sheet, and a topping lift.

Among the several objects of the present invention may be noted the provision of an improved arrangement for securing of the clew of a roll-furling mainsail to a boom; the provision of such an arrangement which provides an advantageous drawing angle for the mainsail at varying stages of furling; the provision of such an arrangement which is easy to operate and which is of relatively simple and inexpensive construction. Other objects and features will be in part apparent and in part pointed out hereinafter.

SUMMARY OF THE INVENTION

Briefly, the present invention relates to a sailboat having a mainsail which is roll-furling at the luff edge thereof. In particular, the invention relates to outhaul apparatus for securing the clew of the mainsail to a boom at varying stages of partial furling. The apparatus employs a car which is freely slidable along the boom and which carries a first block. A second block is secured to the clew of a mainsail. An outhaul line, rigged to pull aft from the tip of the boom, passes forward through the block of the car, thence through the block at the clew of the mainsail and then back to the car where it is secured. This arrangement provides a balance of forces on the car which bias it to a position along the boom providing an advantageous drawing angle for shaping the mainsail.

BRIEF DESCRIPTION OF THE DRAWINGS

Corrresponding references characters indicate corresponding parts throughout the several views of the drawings.

DESCRIPTION OF THE PREFERRED EMBODIMENT

Figure 1:
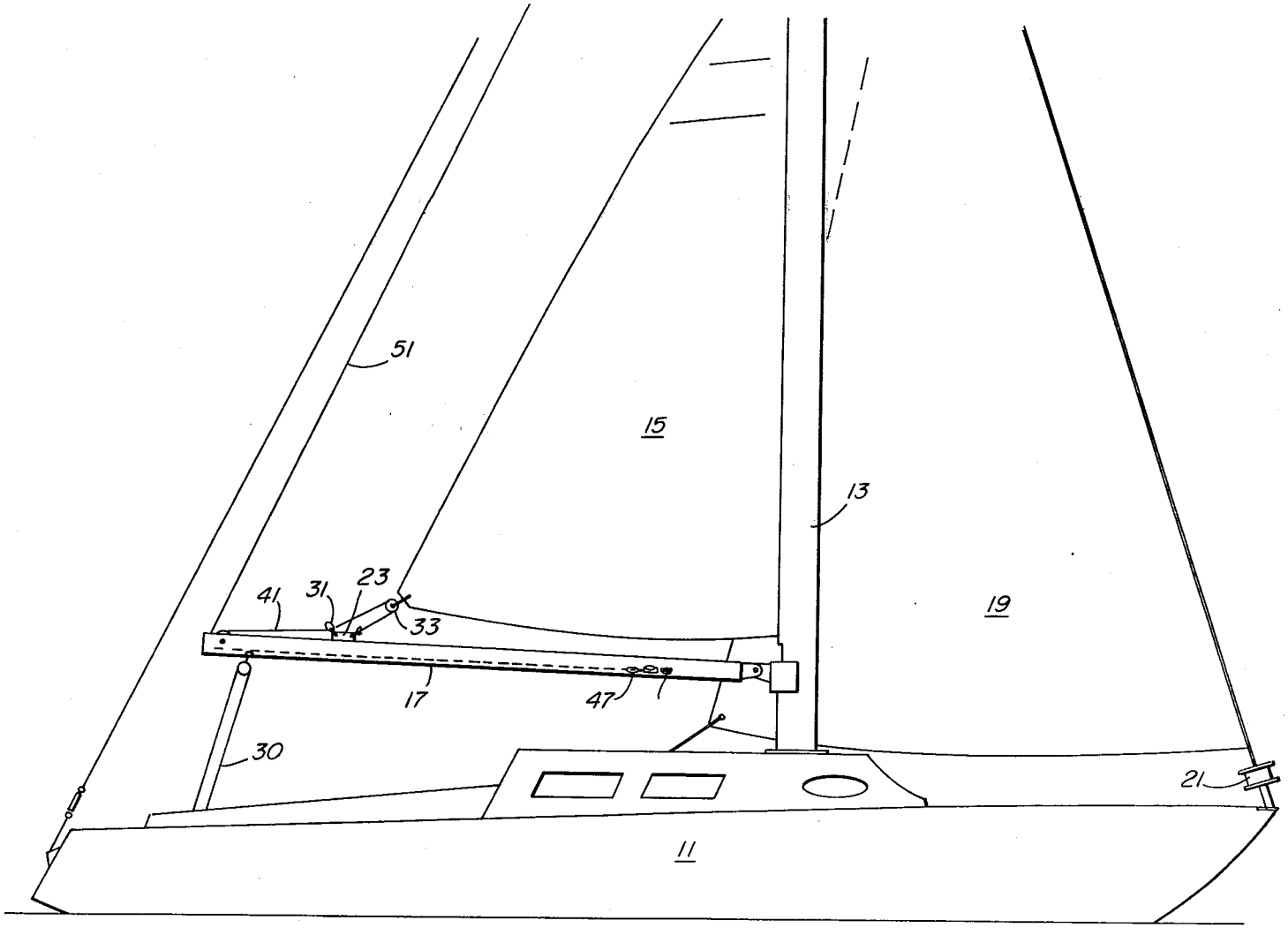
FIG. 1 is a side view of a cruising type sailboat having a roll-furling mainsail, the clew of which is secured to a boom by apparatus constructed in accordance with the present invention.

Referring now to FIG. 1, there is indicated at 11 the hull of a cruising type auxiliary sailboat having a conventionally stayed mast 13 adapted for internal mainsail furling, e.g. as described in the previously mentioned Jackson U.S. Pat. No. 3,835,804. As described in that patent, the mainsail roller furls along its luff edge in a compartment within the mast and exits through an aft-facing slot from that compartment. The mainsail, designated 15, is loose-footed and is trimmed to a boom 17 as described in greater detail herein. The boat is also provided with a jib 19 and, in order to provide the maximum flexibility in ease of setting and furling sail area, this jib is preferably also provided with conventional jib furling gear as indicated diagrammatically at 21.

In accordance with the present invention, the clew of the mainsail 15 is secured to a car which is freely slidable along the length of the boom. The car, designated 23, is illustrated in more detail in FIGS. 2 and 3. The car of a construction which is essentially conventional for travellers and the like and employs ball-bearing journaled wheels 25 adapted to roll along an elongate track. As illustrated, the track, designated 27, is integrally extruded with the boom 17. It should be understood, however, that a conventional commercially-available track might be suitably fastened to the boom, either inside or outside of the usual tubular extrusion section. The car 23 carries a first block 31 while a second block 33 is attached to the clew 35 of the mainsail 15.

Figure 2:
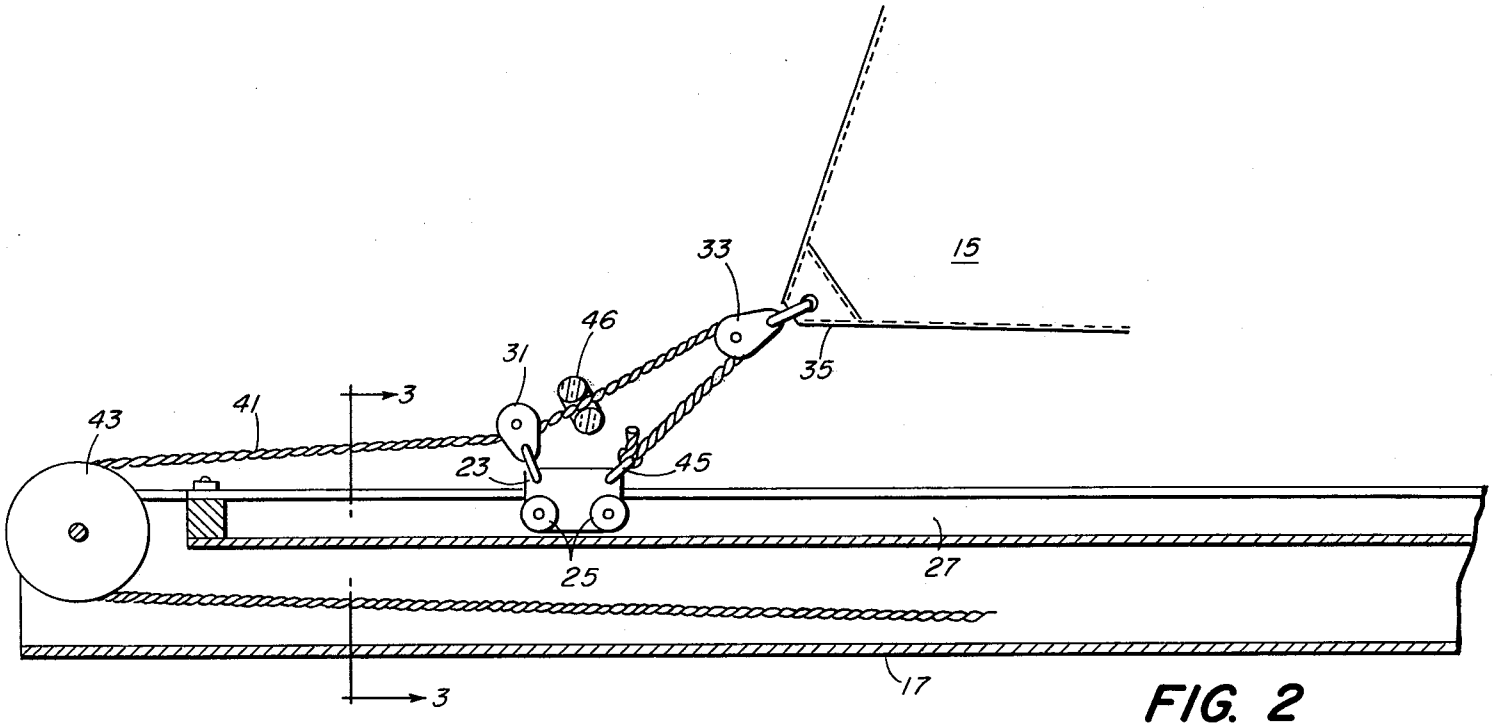
FIG. 2 is a side view to enlarged scale of the clew-securing apparatus.
Figure 3:
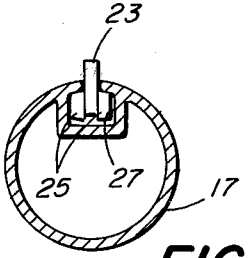
FIG. 3 is a sectional view through the boom of the boat of FIG. 1, taken substantially on the line 3—3 of FIG. 2.

An outhaul line 41 is rigged to pull aft from the tip of the boom by means of a sheave 43 journaled at the boom tip. From the sheave 43, the outhaul line 41 passes forward and through the block 31 on the car 23, thence through the block 33 on the clew of the sail, and then back to the car 23 where it is secured, e.g. by a shackle as indicated at 45. Preferably, a doughnut shaped buffer 46 constructed of a relatively soft plastic is placed around the line 41 between the two blocks 31 and 33 to prevent the blocks from jamming together. For ease in adjustment, the control end of the outhaul line 41 is preferably led forward inside the boom as shown in FIG. 2 to a feedthrough 47 and a cleat 49 where it may be adjustably secured as shown in FIG. 1.

Preferably, the boom 17 is also provided with a topping lift, indicated at 51 in FIG. 1, which is fed over a second sheave mounted parallel to the outhaul sheave 43, the topping lift then also being led forward inside the boom, where it may be conveniently secured near the gooseneck.

The singular advantage of this form of rigging for the mainsail clew is that the position of the car 23 does not have to be independently controlled in a manner which would require additional lines. Rather, the car 23 is freely slidable along the boom and is acted upon by a balance of forces which dynamically urge the car to a position automatically providing an appropriate drawing angle for shaping the mainsail. Further, this essentially automatic seeking of the desired position of the outhaul car allows the boom to maintain an essentially normal height. Accordingly, the mainsail sheet, designated 30, can operate conventionally to control the angle of the boom with respect to the relative direction of the wind.

In general, the car 23 will tend to seek a position which is something less than halfway out along the boom from the clew of the sail. Further, the car will tend to seek such a position for varying stages of partial furling. As will be understood from the general proportions of FIG. 1, the mainsail is, in that drawing, shown in a substantially furled position, i.e., with the working area of the sail substantially reduced. Such a partially furled attitude might be suitable for sailing in quite heavy winds. Under lighter wind conditions, however, the outhaul line can be tightened while letting off of the roller-furling apparatus so that more of the mainsail area is exposed to the wind. As this happens, the clew will move aft a corresponding distance while the car 27 will move a portion of that distance, again seeking a position which will provide an advantageous drawing angle for shaping the mainsail, owing to the advantageous balance of forces exhibited by the particular rigging arrangement.

While the particular roller furling mechanism used forms no part of the present invention, a preferred form of mechanism is shown in co-assigned U.S. patent application Ser. No. 718,949, filed Aug. 30, 1976 and entitled, Boom Gooseneck Fitting Providing Mainsail Roller-Furling, being filed of even date herewith.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. In a sailboat having a mainsail which is roll-furling at the luff edge thereof, outhaul apparatus for securing the clew of the mainsail to a boom at varying stages of partial furling, said apparatus comprising:

a car which is freely slidable along the boom in dynamic response to forces exerted on said car;

a block carried by said car;

a block at the clew of said mainsail; an outhaul line rigged to pull aft from the tip of the boom, said line passing from the tip of the boom forward through the block on said car, thence through the block on the sail and then back to the car where it is secured to the car, whereby the balance of forces exerted on said car by said line bias said car to a position along said boom providing an advantageous drawing angle for shaping said mainsail.

2. Outhaul apparatus as set forth in claim 1 wherein said car rolls on wheels in a track extending along said boom.

3. Outhaul apparatus as set forth in claim 2 wherein said boom is an extrusion and said track is extruded integrally with the boom.

4. Outhaul apparatus as set forth in claim 1 wherein said sailboat includes a conventionally stayed mast and wherein said boom is attached to the mast at a gooseneck fitting and wherein the end of the boom opposite the mast carries a sheave for directing said outhaul line in toward the gooseneck fitting for convenient operation.

5. Outhaul apparatus as set forth in claim 4 wherein said mainsail roller furls into a tubular compartment within the mast and may be drawn from said compartment through an aft-facing slot in the mast.

6. Outhaul apparatus as set forth in claim 1 further comprising a doughnut shaped buffer around said line between said blocks.

* * * * *